US005724683A

United States Patent [19]

Sorimachi et al.

[11] Patent Number: 5,724,683

[45] Date of Patent: Mar. 10, 1998

[54] HINGE MECHANISM FOR SUPPORTING THE SEAT OR THE SEAT LID OF A TOILET BOWL

[75] Inventors: Akira Sorimachi; Kanetsugu Miyazaki, both of Kanagawa, Japan

[73] Assignee: Katoh Electrical Machinery Co., Ltd., Kanagawa, Japan

[21] Appl. No.: 543,126

[22] Filed: Oct. 13, 1995

[30] Foreign Application Priority Data

Oct. 20, 1994 [JP] Japan ..... 94-255855
Sep. 26, 1995 [JP] Japan ..... 95-010133 U

[51] Int. Cl.[6] ..... A47K 13/12

[52] U.S. Cl. ..... 4/248; 16/50; 16/303

[58] Field of Search ..... 4/241, 246.1, 246.2, 4/248; 16/50, 303

[56] References Cited

U.S. PATENT DOCUMENTS 571,133 11/1896 Hoffman ..... 16/303
3,518,716 7/1970 Larson ..... 16/50 X
5,138,743 8/1992 Hoffman ..... 16/303

FOREIGN PATENT DOCUMENTS 3722114 1/1988 Germany ..... 4/248
3718705 12/1988 Germany ..... 4/248
4259424 9/1992 Japan ..... 4/246.1
6142005 5/1994 Japan ..... 4/248

*Primary Examiner*—Robert M. Fetsuga
*Attorney, Agent, or Firm*—Notaro & Michalos P.C.

[57] ABSTRACT

A hinge mechanism for a toilet bowl seat or seat lid has improved control of rotation due to torque exerted by a cam member working with a compression spring and slider, such that the torque varies depending on the angle of the seat or seat lid to the plane of the toilet bowl. The slider and cam member are mounted on a shaft having an axially directed oval hole in which a complementary shaped hinge pin is received to connect the seat and the seat lid to the mechanism. A stop mechanism prevents the shaft from turning beyond a predetermined angle.

7 Claims, 7 Drawing Sheets

HINGE MECHANISM FOR SUPPORTING THE SEAT OR THE SEAT LID OF A TOILET BOWL

BACKGROUND OF THE INVENTION

1. Field of the Invention

The present invention relates to a hinge mechanism suitable for supporting the seat or the seat lid of a toilet bowl.

2. Description of the Related Art

A known hinge mechanism for supporting the seat or the seat lid of a toilet bowl employs a torsion coil spring to urge the seat or the seat lid in an opening direction so that the seat or the seat lid can be lightly opened and may not slam down when closing the same.

Generally, the torque of a torsion spring varies linearly with twist angle and therefore the torque of the torsion spring does not match exactly with the rotation moment of the seat or the seat lid that varies in a gentle sinusoidal curve with angle. Since the torsion spring is twisted to a maximum extent when the seat or the seat lid is turned to its closed position, the seat or the seat lid is liable to be raised slightly from the closed position after closing, and the torque of the torsion spring exceeds the rotation moment of the seat or the seat lid when the seat or the seat lid is turned near to its open position and the seat or the seat lid is slammed against the water tank by the torsion spring.

When attaching a hinge mechanism employing a torsion spring to a toilet bowl after assembling the hinge mechanism and a seat or a seat lid, the hinge mechanism can be comparatively easily attached to the toilet bowl because the seat or the seat lid is held at a certain angular position relative to the hinge mechanism by the torsion spring. A hinge mechanism employing a combination of a compression spring and a sliding cam for controlling a seat or a seat lid like a hinge mechanism of the present invention requires difficult work for attaching the hinge mechanism to a toilet bowl after assembling the hinge mechanism and the seat or the seat lid, because the seat or the seat lid is able to turn through 360° relative to the hinge mechanism.

OBJECT OF THE INVENTION

It is a first object of the present invention to provide a hinge mechanism for supporting the seat or the seat lid of a toilet bowl, capable of enabling the seat or the seat lid to be turned lightly in the opening direction, of not springing up the seat or the seat lid when the seat or the seat lid is turned near to its fully open position, of making the seat or the seat lid turn gradually in the closing direction and of securely holding the seat or the seat lid at its closed position.

A second object of the present invention is to provide a hinge mechanism for supporting the seat or the seat lid of a toilet bowl, capable of enabling the seat or the seat lid to be turned lightly in the opening direction, of not springing up the seat or the seat lid when the seat or the seat lid is turned near to its fully open position, of making the seat or the seat lid turn in a predetermined limited angular range, of making the seat or the seat lid turn gradually in the closing direction and of securely holding the seat or the seat lid at its closed position.

DESCRIPTION OF THE PREFERRED EMBODIMENTS

Figure 1:
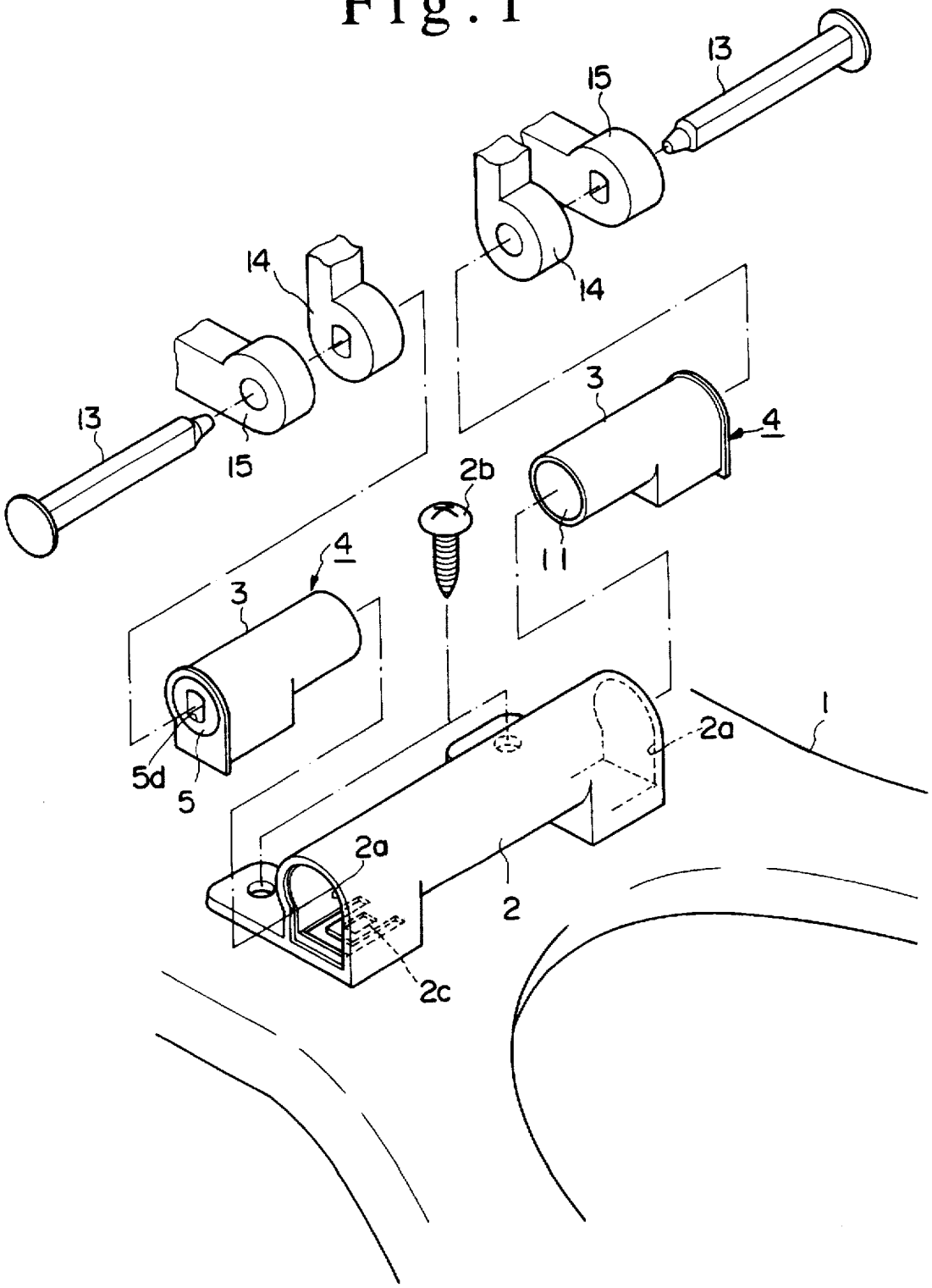
FIG. 1 is an exploded perspective view of a hinge mechanism in a preferred embodiment of the present invention as attached to a toilet bowl.
Figure 3:
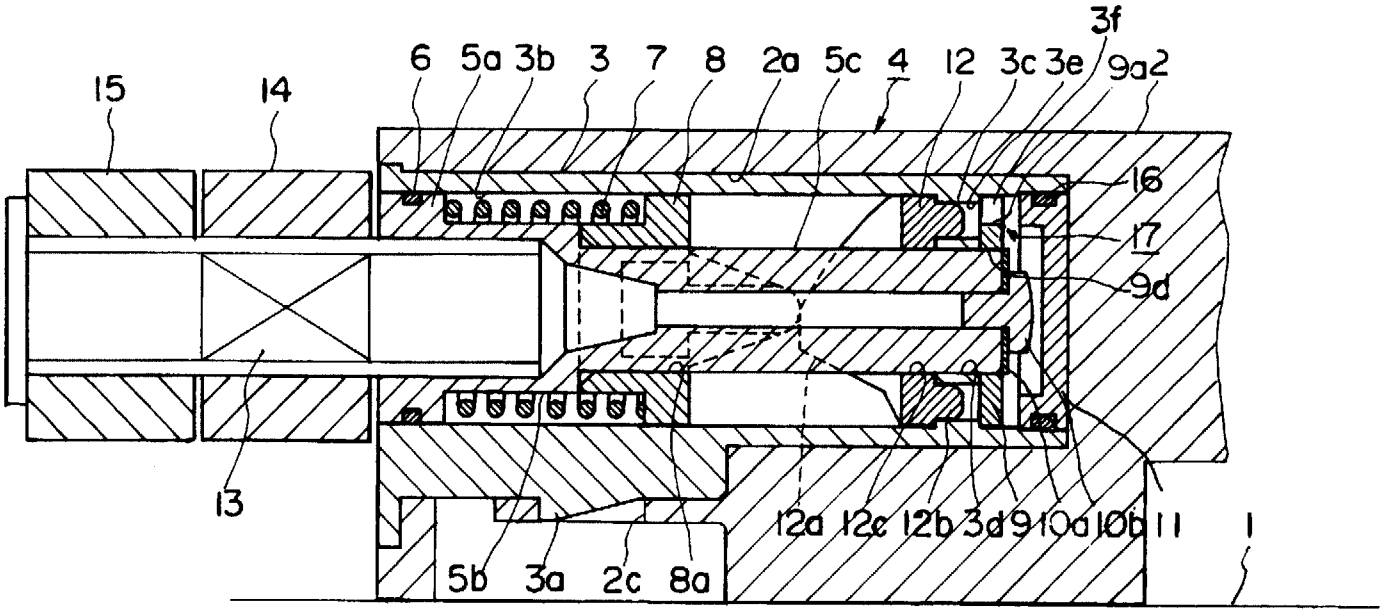
FIG. 3 is a longitudinal sectional view of the hinge mechanism of FIG. 1.

Referring to FIG. 1 showing a pair of hinge mechanism 4 in a preferred embodiment according to the present invention, a support member 2 provided with a pair of coaxial bores 2*a* at its opposite ends is fastened with a pair of bolts 2*b* to the substantially middle portion of the upper surface of the rear part of a toilet bowl 1, and cylindrical cases 3 of the pair of hinge mechanisms 4 are detachably inserted in the bores 2*a*, respectively, and held in place in the bores 2*a* with stopping projections 3*a* formed in the lower portions of the case 3 in engagement with stopping part 2*c* formed in the bores 2*a*, respectively, as shown in FIG. 3.

As shown in FIG. 1, one of the pair of hinge mechanisms 4 supports a seat 18 (FIG. 8) and the other supports a seat lid, not shown, and the pair of hinge mechanisms 4 are in mirror-image relationship with each other and are the same in construction. Therefore, only the hinge mechanism 4 supporting the seat 18 will be described below.

Figure 2:
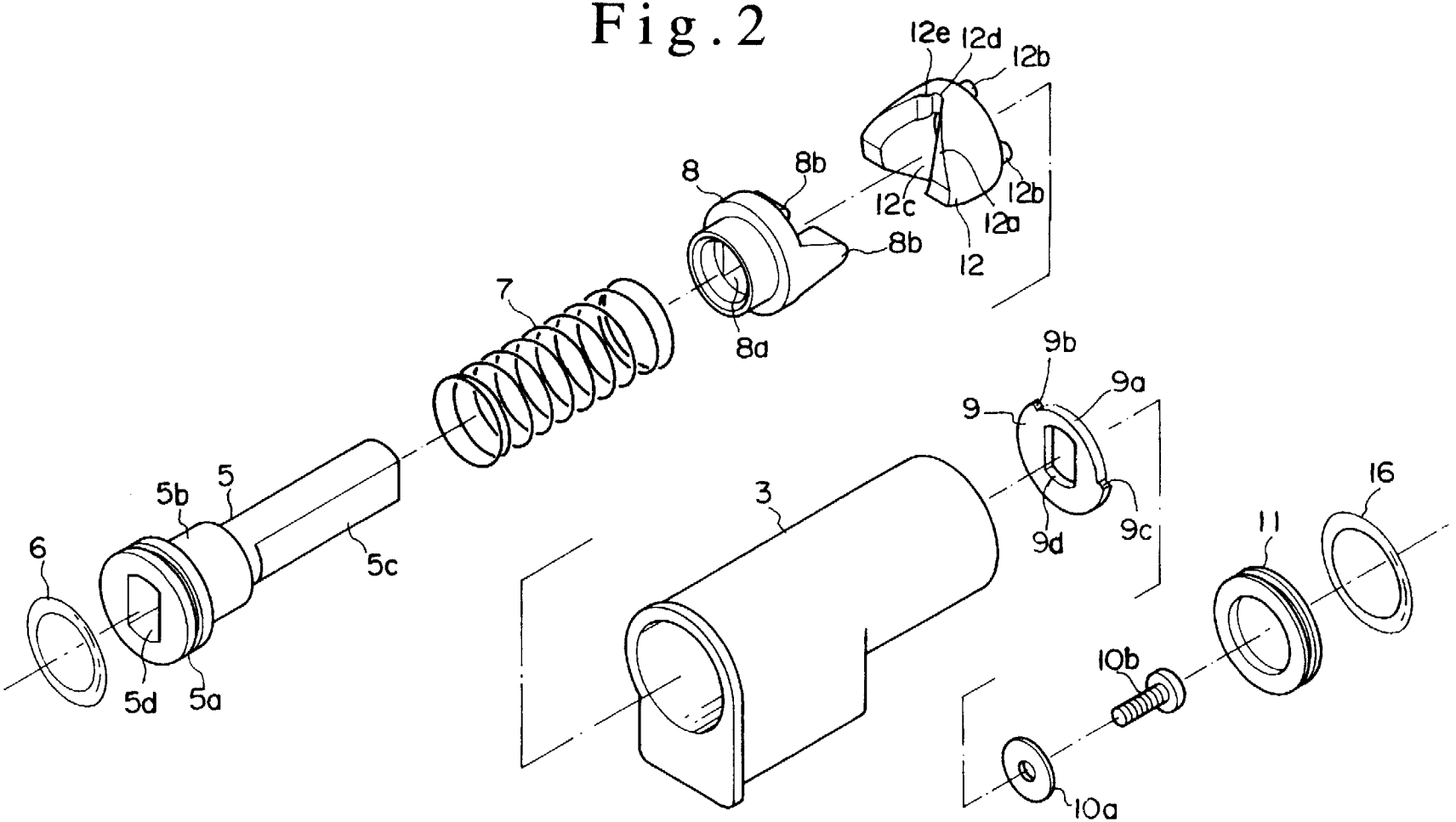
FIG. 2 is an exploded perspective view of the hinge mechanism of FIG. 1.
Figure 6:
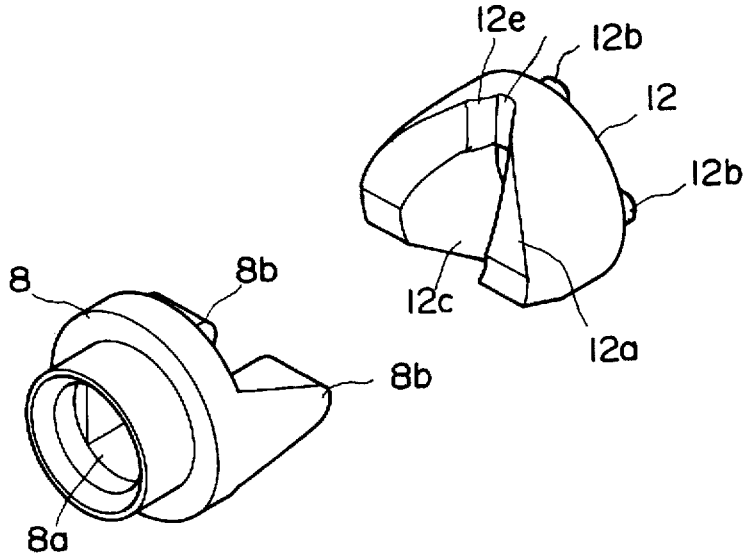
FIGS. 6 and 7 are perspective views of a slider and a cam member as viewed from different directions.
Figure 7:
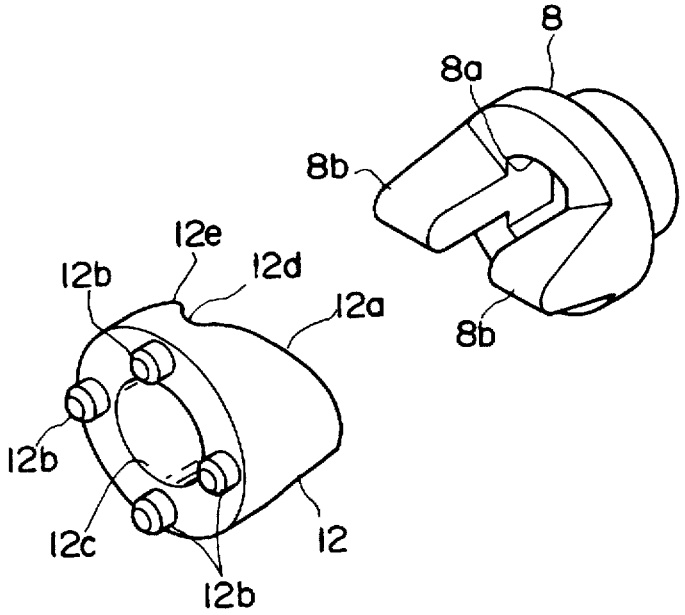
Figure 8:
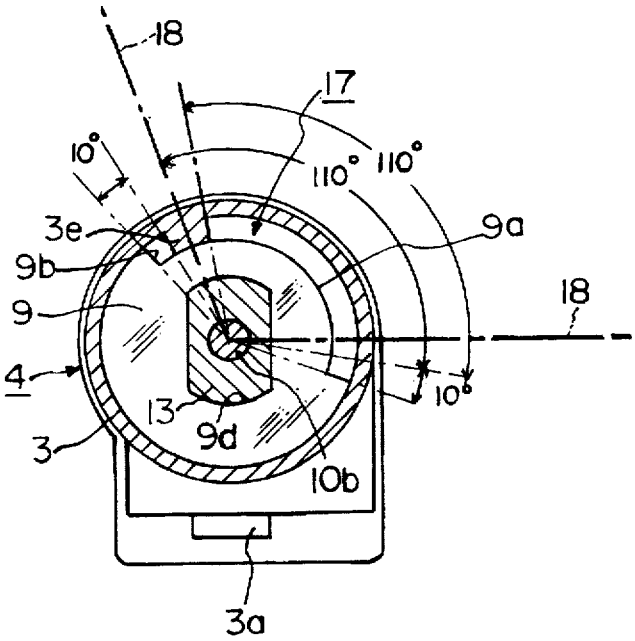
FIG. 8 is a sectional view of assistance in explaining the construction and the operation of a stopping mechanism.

Referring to FIGS. 2 to 5, a shaft 5 is inserted in and supported on the case 3 for turning about its axis. The shaft 5 has a flange 5*a* fitted in its circumference with a sealing member 6, such as an O ring, an expanded section 5*b* extending from the flange 5*a*, a reduced section 5*c* having a substantially oval cross section and extending from the extremity of the expanded section 5*b*, and an oval hole 5*d* formed through the flange 5*a* into the expanded section 5*b* coaxially with the expanded section 5*b*. One end of a compression spring 7 is wound around the expanded portion 5*b* of the shaft 5, and a slider 8 having a center hole 8*a* having a shape corresponding to the substantially oval cross section of the reduced section 5*c* of the shaft 5 is slidably mounted on the reduced section 5*c* so as to be turned together with the shaft 5. The extremity of the reduced section 5*c* is supported in a bearing hole 3*d* formed in a bearing wall 3*c* formed within the case 3. The compression spring 7 is compressed between the flange 5*a* and the slider 8 to urge the slider 8 in one direction, i.e., to the right as viewed in FIG. 3. As best shown in FIGS. 6 and 7, the slider 8 has a pair of projections 8*b* axially projecting from diametrically opposite positions from the inner end surface of the slider 8. The extremity of the reduced section 5*c* of the shaft 5 is inserted in a hole 9*d* formed in a stopping plate 9 and having a shape corresponding to the substantially oval cross section of the reduced section 5*c*, and the stopping plate 9 is fastened through a washer 10*a* to the extremity of the reduced section 5*c* with a screw 10*b*, so that the shaft 5 is restrained from slipping out of the case 3 by the bearing wall 3c and the stopping plate 9 rotates together with the shaft 5. A cap 11 fitted in its circumference with a sealing member 16, such as an O ring, is fitted in the inner end of the case 3 to conceal the case 3 and to seal the case 3 from water and moisture. Part of the circumference of the stopping plate 9 is cut to form a recess 9a, a first shoulder 9b and a second shoulder 9c as shown in FIGS. 2 and 8. A projection 3f projecting from the inner surface of the case 3 is received in the recess 9a of the stopping plate 9 to form a stopping mechanism 17.

The first shoulder 9b comes into contact with the projection 3f when the stopping plate 9 is turned together with the shaft 5 in one direction to limit the turning of the shaft 5 in that direction and the second shoulder 9c comes into contact with the projection 3f when the stopping plate 9 is turned together with the shaft 5 in the opposite direction to limit the turning of the shaft 5 in that direction. Thus, the shaft 5 is able to turn a limited angular range defined by the stopping mechanism 17. The hinge mechanism 4 can be easily attached to the toilet bowl because the seat 18 is restrained from free turning relative to the hinge mechanism 4 when attaching the hinge mechanism 4 to the toilet bowl. Although the seat 18 needs to be turned through an angle of 110°, the hinge mechanism 4 allows the seat 18 to turn through an angle of 110°+10° as shown in FIG. 8. The stopping mechanism 17 may comprise, for example, a pair of projections projecting from the inner surface of the case 3 and spaced from each other by an appropriate angle, and a projection attached to or formed integrally with the shaft 5. When designing conditions permits, the stopping plate 9 may be substituted by a flange formed integrally with the shaft 5.

As shown in FIGS. 6 and 7, a cam member 12 has a pair of cam surfaces 12a formed diametrically opposite to each other in one end surface thereof, four projections 12b formed on the other end surface at equal angular intervals and a center hole 12c. As shown in FIG. 3, the four projections 12b of the cam member 12 are pressed in holes 3e formed in the inner surface of the bearing wall 3c. The reduced section 5c of the shaft 5 extends rotatably through the center hole 12c, and the cam surfaces 12a are in contact with the projections 8b of the slider 8, respectively.

As shown in FIGS. 1 and 3, a hinge pin 13 having a flange and an oval section is put through a round hole of a knuckle 15 of the seat lid and an oval hole of a knuckle 14 of the seat 18 and pressed in the oval hole 5d of the shaft 5. The knuckle 14 of the seat 18 is unable to turn relative to the hinge pin 13, and the knuckle 15 of the seat lid is able to turn on the hinge pin 13. As is obvious from FIG. 1, the other knuckle 14 of the seat 18 is able to turn on the other hinge pin 13 pressed in the shaft 5 of the other hinge mechanism 4 and the other knuckle 15 of the seat lid is unable to turn relative to the same hinge pin 13.

Figure 4:
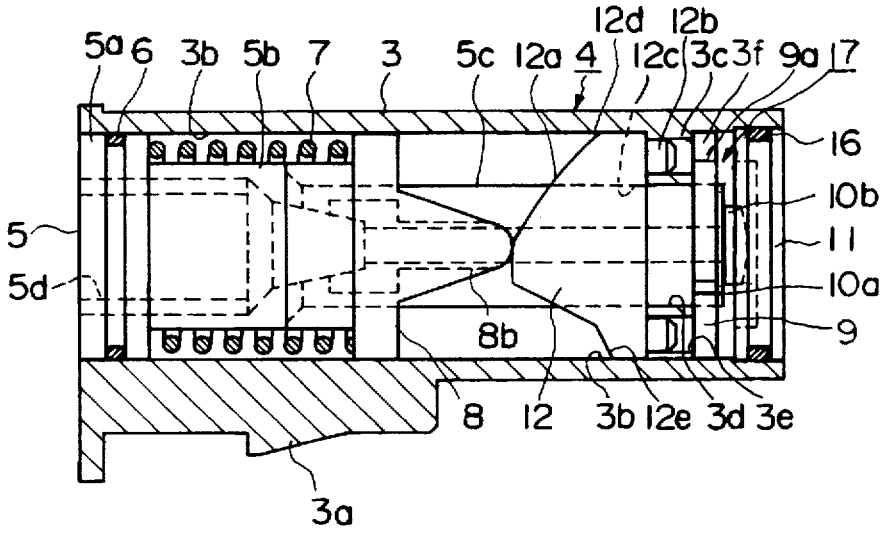
FIG. 4 is a longitudinal sectional view of the hinge mechanism of FIG. 1 in a position where the seat or the seat lid supported thereon is at its closed position.
Figure 5:
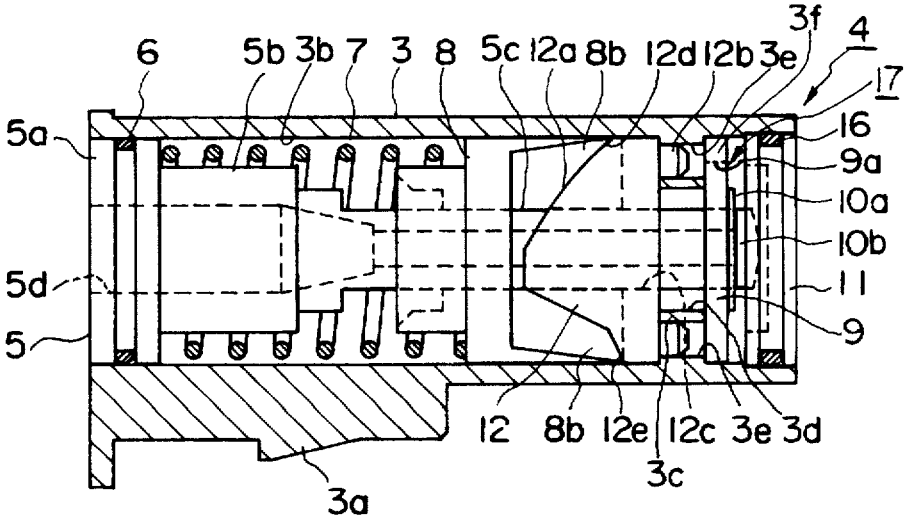
FIG. 5 is a longitudinal sectional view of the hinge mechanism of FIG. 1 in a position where the seat or the seat lid is opened in an upright position.
Figure 10:
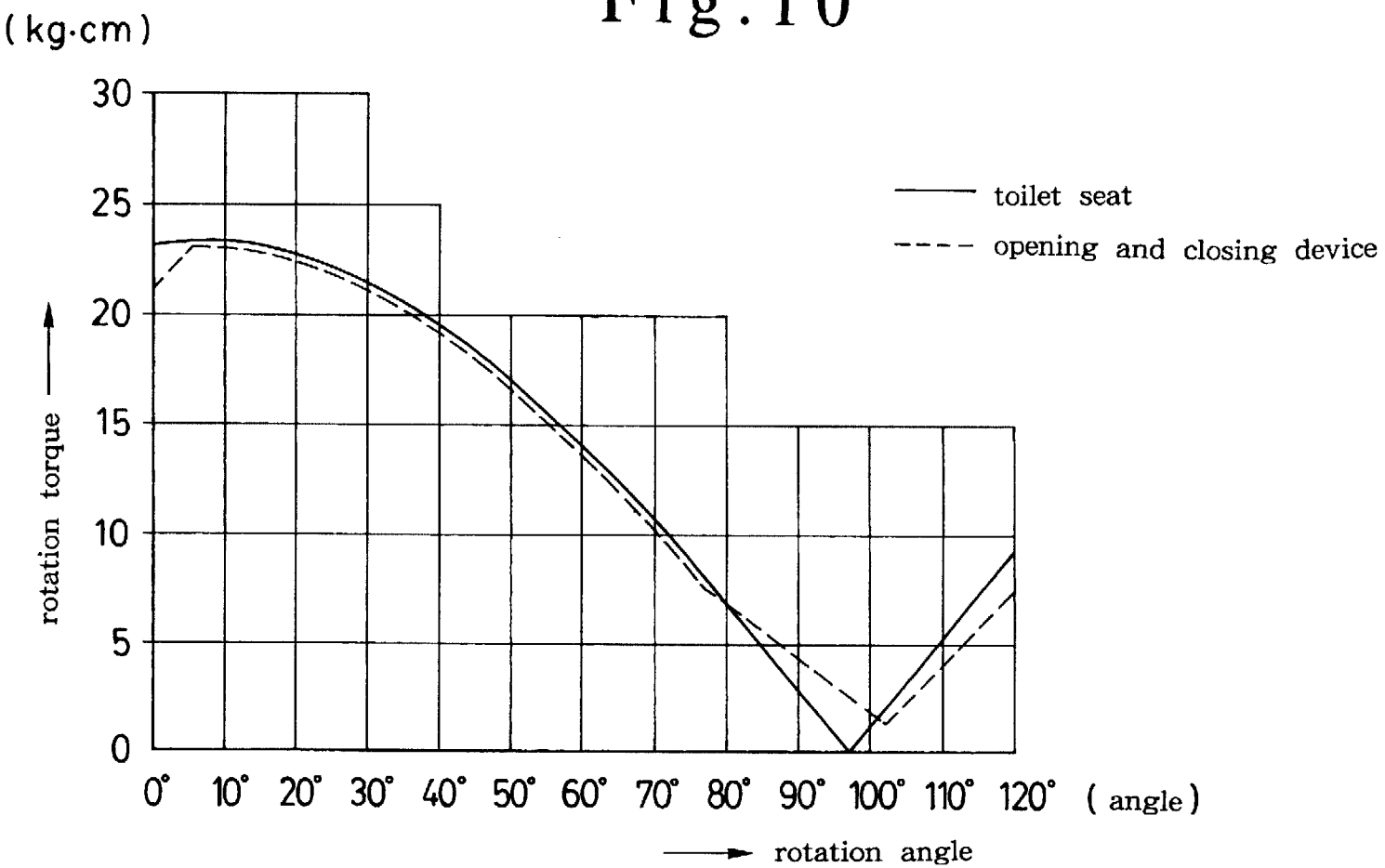
FIG. 10 is a diagram showing the variation of the respective torques of the hinge mechanism of FIG. 1 and a seat supported on the same hinge mechanism with angle.

FIG. 4 shows the hinge mechanism 4 in a state where the seat 18 is at the closed position. In this state, the projections 8b of the slider 8 are in contact with the cam surfaces 12a of the cam member 12 at comparatively gently sloping positions slightly before the highest points of the cam surfaces 12b, respectively, and the projection 3f of the stopping mechanism 17 is about 10° before the first shoulder 9b of the recess 9a as shown in FIG. 8. As shown in FIG. 10, a torque produced by the compression spring 7 is slightly lower than the torque of the seat 18 in the angular range of 0° to about 80°, and a torque produced by the compression spring 7 is slightly lower than a maximum torque that can be produced by the compression spring 7 when the seat 18 is at the closed position as shown in FIG. 4. When the seat 18 is turned to the open position, the shaft 5 is turned counterclockwise, as viewed in FIG. 8, by the hinge pin 13 and the projections 8b of the slider 8 slides along the cam surfaces 12a to the lowest points 12d of the cam surfaces 12b, respectively. Since a reaction from the cam member 12 resulting from the pressure applied by the compression spring 7 through the slider 8 to the cam member 12 produces a torque to turn the shaft 5 counterclockwise, when the projections 8b of the slider 8 slides along the cam surfaces 12a to the lowest points 12d, the seat can be substantially weightlessly opened.

Figure 9:
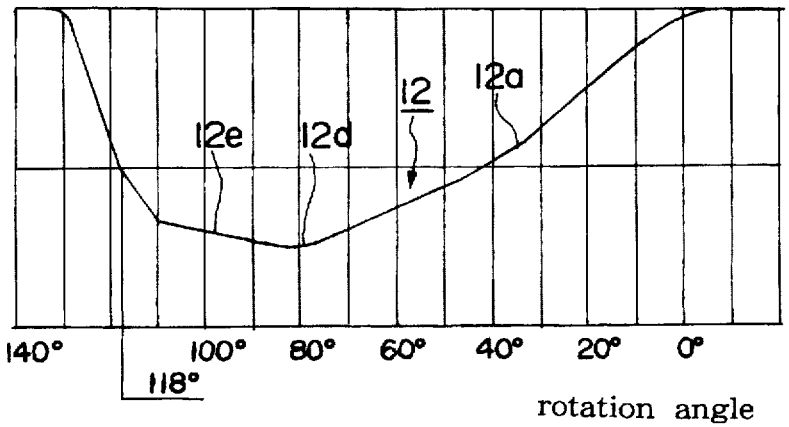
FIG. 9 is a development of the cam contour of the cam member.

When the seat 18 is turned further in the opening direction beyond an 80° position, the projections 8b of the slider 8 slide along gently rising slopes 12e of the cam surfaces 12a, respectively, as shown in FIG. 9, so that the compression spring 7 starts being compressed to exert a braking force on the seat 18 in a direction opposite the opening direction and the torque resulting from the pressure applied by the compression spring 7 through the slider 8 to the cam member 12 exceeds the moment of the seat 18 as shown in FIG. 10. Therefore, the seat 18 does not spring up and does not slam against the water tank with large noise. When the seat 18 is turned to a 110° position, i.e., the fully open position, the projections 8b of the slider 8 come into contact with the sharply rising slopes of the cam surfaces 12a, respectively. In this state, the projection 3f of the stopping mechanism 17 is at a position about 10° before the second shoulder 9c of the recess 9a and spaced from the second shoulder 9c of the recess 9a.

When the fully opened seat 18 is turned in the closing direction, the projections 8b of the slider 8 turning together with the shaft 5 slide up the up slopes of the cam surfaces 12a, respectively, against the resilience of the compression spring 7. Since a varying torque produced by the resilience of the compression spring 7 and acting against the downward turning of the seat 18 is substantially equal to or slightly lower than the torque of the seat 18 varying with angle as shown in FIG. 10, the downward turning of the seat 18 is not accelerated and the seat 18 will not slam down.

The cam surfaces 12a of the cam member 12 are designed so that the torque produced by the reaction resulting from the pressure exerted on the cam surfaces 12a by the compression spring 7 is slightly lower than the torque of the seat 18 in most part of the angular range of turning of the seat 18, the compression spring 7 is compressed to a maximum extent when the seat 18 is turned to a position around a 15° position, and the compression spring 7 compressed to a maximum extent is allowed to expand slightly after the seat 18 is tuned in the closing direction beyond the 15° position. Therefore, the seat 18 turned to the closed position is not raised and rests securely at the closed position.

What is claimed is:

1. A hinge mechanism for supporting a seat or a seat lid of a toilet bowl, comprising:

a substantially cylindrical case having a bearing wall formed within said case and mounting means for mounting on said toilet bowl;

a shaft having an oval hole in axial direction thereof, and rotatably inserted in said cylindrical case;

a hinge pin for supporting the seat or the seat lid, said hinge pin having oval sections and inserted in said oval hole so as to rotate with said shaft;

a cam mechanism comprising a slider axially slidably mounted on said shaft within the case so as to turn together with the shaft, and a cam member fixedly mounted on said bearing wall and having a center hole and rotatably receiving the shaft therein; and a compression spring wound around the shaft and compressed between the shaft and slider so as to urge the slider resiliently toward the cam member, wherein the compression spring, the slider, and a working surface of the cam member are designed so that the shaft has a lower torque than a torque of the seat or the seat lid between from 0° to a predetermined opening angle and has an equal torque in a middle opening angle of the seat or the seat lid, and has a higher torque than the torque of the seat or the seat lid between from a predetermined opening angle to a maximum opening angle.

2. A hinge mechanism for supporting a seat or a seat lid of a toilet bowl, comprising:

a substantially cylindrical case having a bearing wall formed within said case and mounting means for mounting on said toilet bowl;

a shaft having an oval hole in axial direction thereof, and rotatably inserted in said cylindrical case;

a hinge pin for supporting the seat or the seat lid, said hinge pin having an oval section and inserted in said oval hole so as to rotate with said shaft;

a cam mechanism comprising a slider axially slidably mounted on said shaft within the case so as to turn together with the shaft, and a cam member fixedly mounted on said bearing wall and having a center hole and rotatably receiving the shaft therein;

a compression spring wound around the shaft and compressed between the shaft and slider so as to urge the slider resiliently toward the cam member; and a stopping means for limiting the turning of the shaft within the case to a predetermined angular range, comprising a stopping plate mounted on the shaft so as to co-rotate with the shaft within the case and provided with a recess, and a projection projecting from the inner surface of the case so as to be received in the recess of the stopping plate.

3. A hinge mechanism for supporting a seat or a seat lid of a toilet bowl, comprising:

a substantially cylindrical case having a bearing wall formed within said case and mounting means for mounting on said toilet bowl;

a shaft having an oval hole in axial direction thereof and rotatably inserted in said cylindrical case;

a hinge pin for supporting the seat or the seat lid, said hinge pin having an oval section and inserted in said oval hole so as to rotate with said shaft;

a sealing member put between the flange of the shaft and the case to seal the case;

a cam mechanism comprising a slider axially slidably mounted on said shaft within the case so as to turn together with the shaft, and a cam member fixedly mounted on said bearing wall and having a center hole and rotatably receiving the shaft therein;

a compression spring wound around the shaft and compressed between the shaft and slider so as to urge the slider resiliently toward the cam member;

a stopping plate mounted on the shaft so as to co-rotate with the shaft; and an end cap fitted in a water-tight fashion in the other end of the case.

4. A hinge mechanism for supporting the seat or the seat lid of a toilet bowl, according to any one of claims 1 to 3, wherein the substantially cylindrical case is provided with a projection to be fitted in an opening formed in a mounting member fixed to the toilet bowl.

5. A hinge mechanism for supporting the seat or the seat lid of a toilet bowl, according to any one of claims 1 to 3, wherein the shaft is provided with an axial hole in which a hinge pin fixedly supporting the knuckle of the seat and rotatably supporting the knuckle of the seat lid or a hinge pin fixedly supporting the knuckle of the seat lid and rotatably supporting the knuckle of the seat is fitted.

6. A hinge mechanism for supporting the seat or the seat lid a toilet bowl, according to any one of claims 1 to 3, wherein the maximum resilience of the compression spring is slightly lower than the weight of the seat or the seat lid.

7. A hinge mechanism for supporting the seat or the seat lid of a toilet bowl, according to claim 2, wherein the stopping means comprises a projection projecting from the inner surface of the case, and a portion of the shaft, provided with a recess having a first circumferential end that comes into contact with the projection when the shaft is turned in one direction and a second circumferential end that comes into contact with the projection when the shaft is turned in the opposite direction to limit turning of the shaft in a predetermined angular range.

* * * * *